US011324304B2

(12) United States Patent
Assa-Darko

(10) Patent No.: US 11,324,304 B2
(45) Date of Patent: May 10, 2022

(54) DECORATIONS

(71) Applicant: Abena Assa-Darko, Purley (GB)

(72) Inventor: Abena Assa-Darko, Purley (GB)

( * ) Notice: Subject to any disclaimer, the term of this patent is extended or adjusted under 35 U.S.C. 154(b) by 75 days.

(21) Appl. No.: 15/976,709

(22) Filed: May 10, 2018

(65) Prior Publication Data

US 2018/0325245 A1 Nov. 15, 2018

(51) Int. Cl.

| | |
|---|---|
| ***A41D 27/08*** | (2006.01) |
| ***A41D 27/20*** | (2006.01) |
| ***A45C 13/00*** | (2006.01) |
| ***A45C 13/08*** | (2006.01) |
| ***A42B 1/248*** | (2021.01) |
| ***A45C 13/20*** | (2006.01) |
| ***A45F 3/00*** | (2006.01) |
| ***A43B 23/24*** | (2006.01) |
| ***A45C 5/03*** | (2006.01) |
| ***A45F 3/04*** | (2006.01) |
| *A45B 25/00* | (2006.01) |

(52) U.S. Cl.

CPC ..... *A45F 3/04* (2013.01); *A41D 27/08* (2013.01); *A41D 27/201* (2013.01); *A41D 27/207* (2013.01); *A43B 23/24* (2013.01); *A45C 5/03* (2013.01); *A45C 13/001* (2013.01); *A45C 13/08* (2013.01); *A41D 2300/322* (2013.01); *A41D 2300/324* (2013.01); *A42B 1/248* (2013.01); *A45B 25/00* (2013.01); *A45B 2025/003* (2013.01); *A45B 2200/1009* (2013.01); *A45C 2200/10* (2013.01); *A45F 2003/001* (2013.01)

(58) Field of Classification Search

CPC ..... A24B 23/24; A41D 27/008; A41D 27/08; A41D 27/201; A41D 27/207; A41D 2300/322; A41D 2300/324; A45C 13/08; A45C 2200/10; A45C 5/03; A45C 13/001; A42B 1/248; A45F 3/04; A45F 2003/001; A43B 23/24; A45B 25/00; A45B 2025/003; A45B 2200/1009

See application file for complete search history.

(56) References Cited

U.S. PATENT DOCUMENTS

| | | | |
|---|---|---|---|
| 4,309,784 | A | 1/1982 | Cohen |
| 5,007,470 | A | 4/1991 | Freeman |
| 5,800,900 | A | 9/1998 | Mitchell |

(Continued)

FOREIGN PATENT DOCUMENTS

| | | | |
|---|---|---|---|
| CA | 2751611 | A1 | 11/2011 |
| CN | 105124892 | A | 12/2015 |

(Continued)

OTHER PUBLICATIONS

American Heritage® Dictionary of the English Language, Fifth Edition. S.v. "integral." Retrieved Jan. 12, 2021 from https://www.thefreedictionary.com/integral (Year: 2021).*

*Primary Examiner* — Khoa D Huynh
*Assistant Examiner* — Erick I Lopez
(74) *Attorney, Agent, or Firm* — Oppenhuizen Law PLC; David L. Oppenhuizen

(57) ABSTRACT

A decorative item comprises at least one area of hook or loop fastening and a cover comprising a substantially see-through portion, wherein the see-through portion is configured to overlay the area of hook or loop fastening. The item comprises a pocket for storing decorations having an opening located under the cover.

14 Claims, 5 Drawing Sheets

(56) References Cited

U.S. PATENT DOCUMENTS

| | | | | |
|---|---|---|---|---|
| 5,943,698 | A * | 8/1999 | Blanks, I | G09F 21/02 2/69 |
| D673,362 | S | 1/2013 | Presman et al. | |
| 2007/0017135 | A1 | 1/2007 | Sharp-Mommeut | |
| 2008/0230576 | A1 | 9/2008 | Arabadjis | |
| 2009/0158490 | A1 | 6/2009 | White et al. | |
| 2012/0137399 | A1* | 6/2012 | Forte | G09F 21/02 2/69 |
| 2015/0053316 | A1* | 2/2015 | Small | A45C 3/001 150/103 |
| 2015/0289629 | A1 | 10/2015 | Nakamura | |
| 2015/0320183 | A1* | 11/2015 | Donahue | A45F 3/042 224/600 |
| 2016/0007719 | A1 | 1/2016 | Harstvedt | |
| 2016/0073753 | A1 | 3/2016 | Tanabe | |

FOREIGN PATENT DOCUMENTS

| | | | |
|---|---|---|---|
| GB | 2504992 | A | 2/2014 |
| GB | 2509968 | A | 7/2014 |
| JP | 3206327 | B2 | 9/2016 |
| KR | 20030015998 | A | 2/2003 |

* cited by examiner

DECORATIONS

CROSS-REFERENCE TO RELATED APPLICATION

This application claims the priority of British Application No. 1707461.8, filed May 10, 2017, the entire disclosure of which is hereby incorporated by reference in its entirety.

FIELD OF THE INVENTION

The present invention relates to improvements in decorations. In particular the present invention relates to improvements in decorations for clothing, footwear and headgear, and personal accessories such as luggage, bags and umbrellas.

BACKGROUND OF THE INVENTION

Items of clothing have in the past been decorated for entertainment and educational purposes.

For example US2007017135 discloses a garment that may be decorated using hook and loop fastening and magnets, and KR20030015998 discloses the decorating of garments and bags using hook and loop fastening.

The present invention seeks to improve upon the prior art.

SUMMARY OF THE INVENTION

According to the present invention there is provided a decorative item comprising:

- at least one area of hook or loop fastening configured to have decorations attached thereto by a user, the decorations comprising corresponding hook or loop fastening;
- a cover comprising at least a portion that is substantially see-through, wherein the see-through portion is configured to overlay the area of hook or loop fastening;
- a pocket for storing decorations having an opening located under the cover;
- wherein the cover is changeable between first and second configurations; wherein:
- in a first configuration the cover is located in a substantially fixed position overlaying the pocket and the area of hook or loop fastening such that decorations attached thereto are visible through the substantially see-through portion;
- in a second configuration the cover is not located over the area of hook or loop fastening such that a user may access the pocket and attach decorations to and detach decorations from the area of hook or loop fastening.

By providing a pocket under the cover decorations are securely retained within the pocket regardless of whether or not the pocket has a fastener and whether or not any such fastener is employed by a user of the item.

In some embodiments the cover forms a secondary pocket on the item such that the secondary pocket is at least in part defined by a rear wall comprising an area of hook or loop fastening and a front wall comprising the see-through cover.

In some embodiments the cover is hingedly attached to the item.

In some embodiments the cover is releasably fixable in its first configuration by means of at least one fastener.

In some embodiments the pocket for storing decorations comprises at least one fastener so seal its opening.

In some embodiments the fastener is a zip, a button or a press stud.

In some embodiments the decorative item is one of an item of clothing, footwear, headgear, luggage, a bag, an umbrella, or a rucksack.

In some embodiments at least 50% of the cover is substantially see-through, or at least 75% of the cover is substantially see-through, or at least 90% of the cover is substantially see-through.

In some embodiments the whole cover is substantially see-through.

In some embodiments the see-through portion of the cover is substantially transparent.

In some embodiments the pocket is located under a portion of the cover that is substantially see-through.

In some embodiments the pocket is located under a portion of the cover that is not substantially see-through.

According to a second aspect of the present invention there is provided a kit comprising:

- a decorative item made in accordance with any preceding statement of invention;
- a plurality of decorations each comprising areas of hook or loop fastening configured to be attached to and detached from the area of hook or loop fastening on the item.

According to a third aspect of the present invention there is provided a method of decorating an item comprising the steps of:

- i) providing an decorative item made in accordance with any preceding statement of invention; and
- ii) attaching at least one decoration to the area of hook or loop fastening on the item.

BRIEF DESCRIPTION OF THE DRAWINGS

In order that the present invention may be more fully understood a specific embodiment will now be described by way of example with reference to the accompanying schematic drawings, of which.

DETAILED DESCRIPTION OF THE PREFERRED EMBODIMENTS

Figure 1:
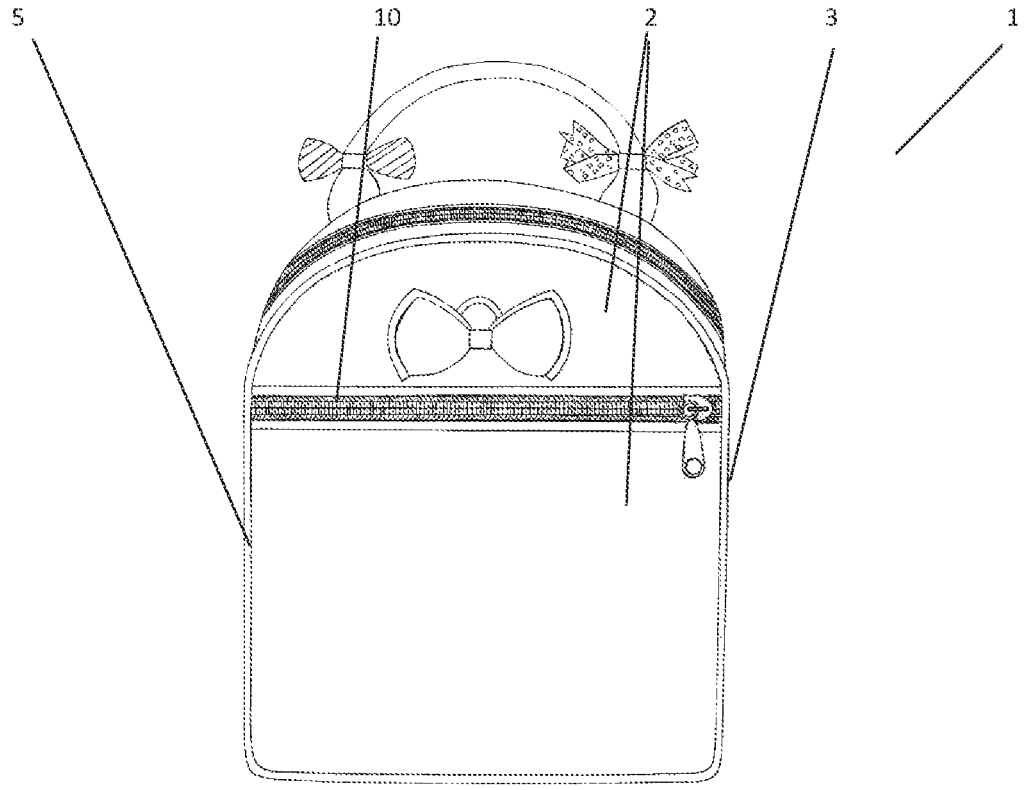
FIG. 1 is view of a front of a rucksack made in accordance with a first embodiment of the present invention and with its see-through cover in a first configuration.

Referring to the drawings, there is provided a rucksack 1 including a wall 20 having an outer face, a second wall 24 opposite to the wall 20, a pair of side walls 25, and a floor 26. The wall 20 and the second wall 24 are spaced apart from one another and each are secured to the pair of side walls 25. The floor 26 is secured to each of the side walls 25, the wall 20, and the second wall 24, whereby the wall 20, second wall 24, pair of side walls 25, and floor 26 define an interior compartment of the rucksack 1. The rucksack 1 additionally includes an interior compartment opening 27, which is preferably a zippered fastener. The second wall 24 includes a pair of shoulder straps 4*a* 4*b* configured to be worn by a user when the rucksack 1 is in use. Accordingly, the outer face of the wall 20 is visible to passers by when the rucksack 1 is in use. The wall 20 includes an area 2 of hook fastening and a see-through cover 3. Optionally the area 2 of hook fastening can include an upper area 28 and a lower area 29. The wall 20 is integrally formed with the rucksack 1, and fixedly attached thereto. See-through cover 3 is flexible and made of a transparent plastics material.

Area of hook fastening 2 is located on an opposite face of rucksack 1 to shoulder straps 4*a* 4*b*, such that when rucksack 1 is being worn by a user area of hook fastening is visible to passers by.

See-through cover 3 is hingedly attached to rucksack 1 at along a first side edge 5 of area of hook and loop fastening 2.

At an opposing edge see-through cover 3 comprises at least one fastener 7, the fastener 7 preferably includes fastening tabs 7*a*, 7*b*, 7*c*, each of which comprise area of loop fastening and are adapted to attach to corresponding areas of hook fastening (not shown) located on a side of rucksack 1 adjacent a second side edge 6 of area of hook fastening 2.

When fastening tabs 7*a*, 7*b*, 7*c* are attached to their corresponding areas of hook fastener, see-through cover 3 is in a first configuration wherein it is retained in a substantially fixed position over area of hook fastening 2, as illustrated in FIG. 1.

Figure 2:
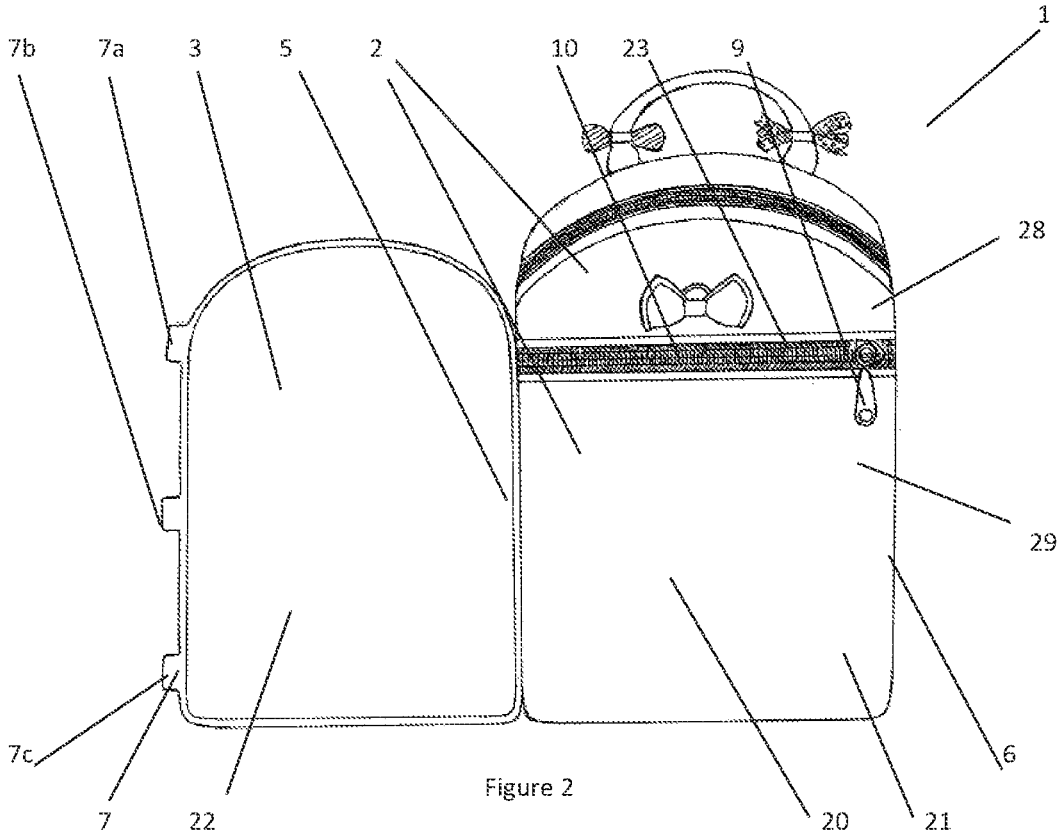
FIG. 2 is a view of the rucksack of FIG. 1 with its see-through cover in a second configuration.
Figure 3:
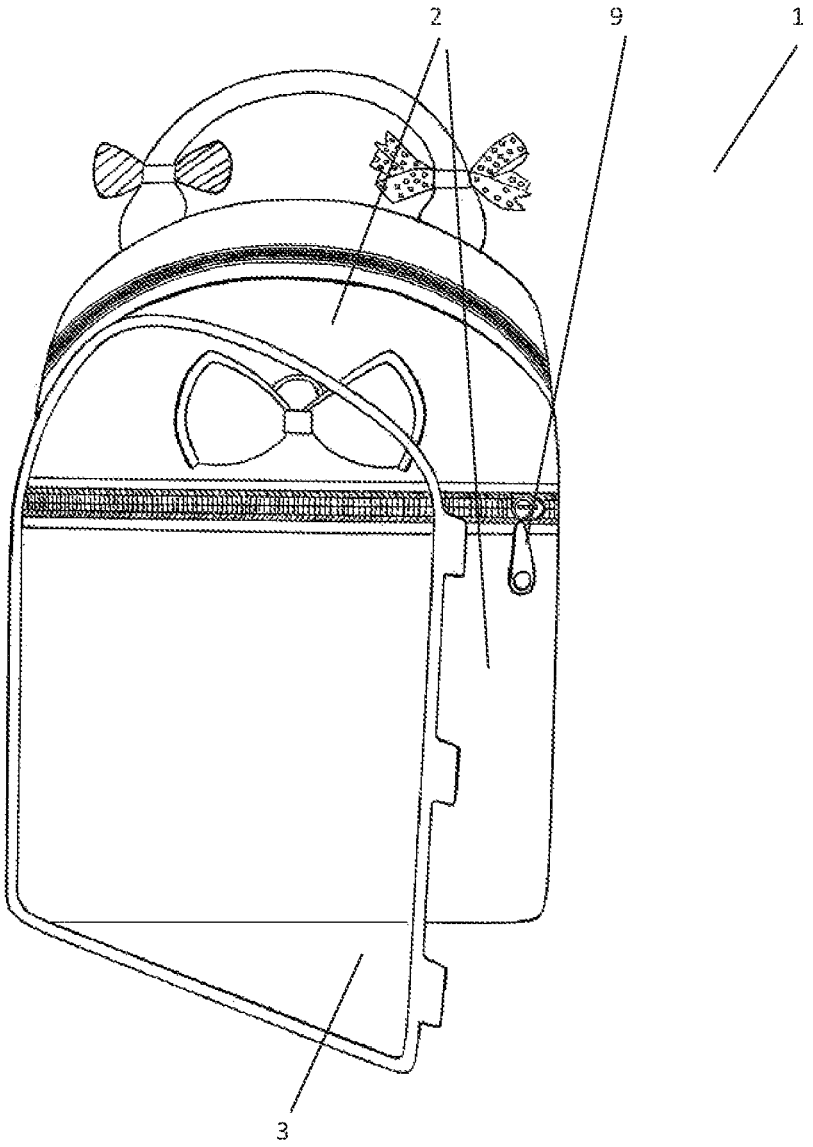
FIG. 3 is a view of the rucksack of FIGS. 1 and 2 illustrating how the see-through cover may move between first and second configurations.
Figure 4:
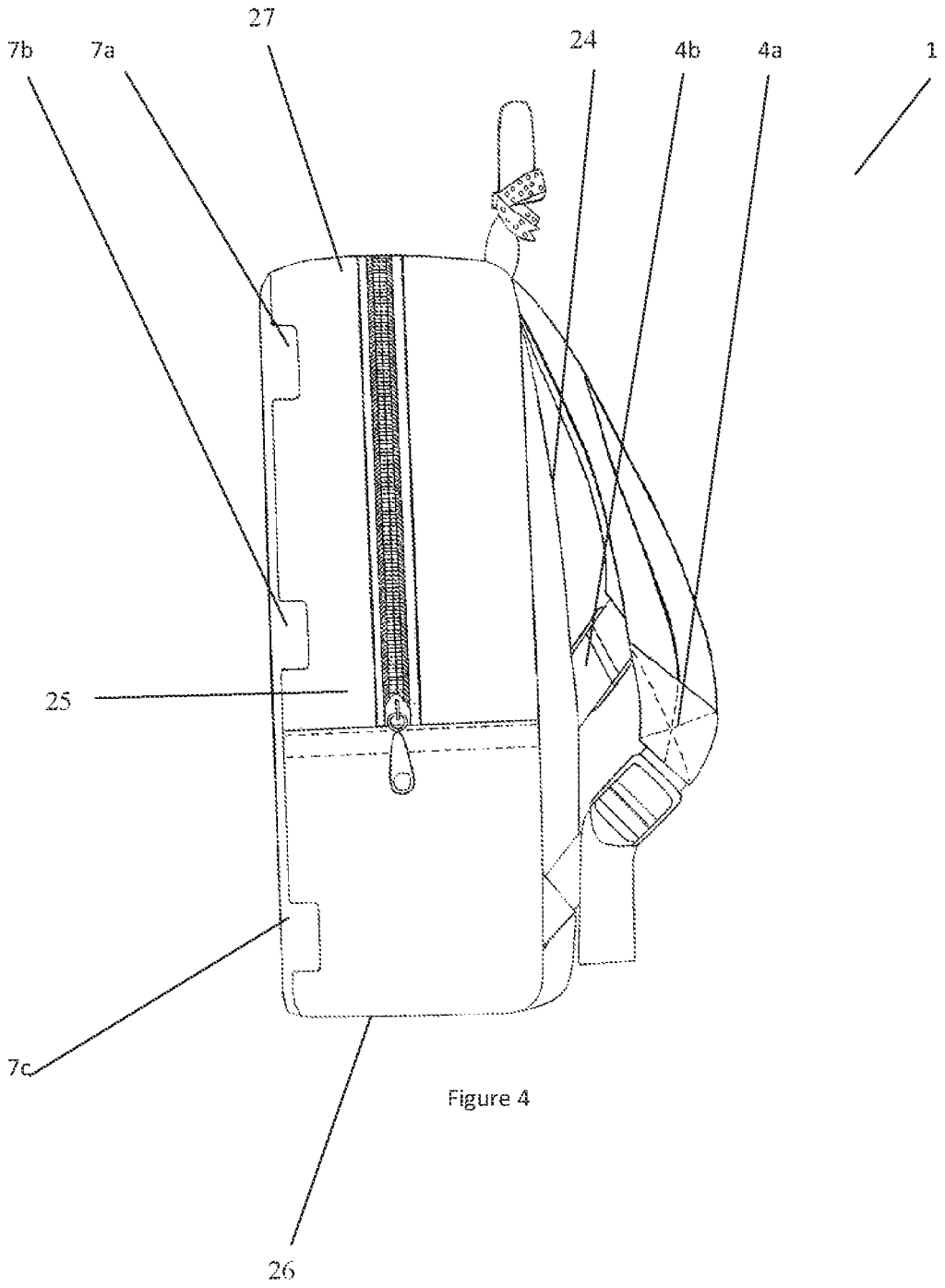
FIG. 4 is a side view of the rucksack of FIG. 1 with its see-through cover in a first configuration.

Fastening tabs 7*a*, 7*b*, 7*c* may be detached from their corresponding areas of hook fastener by a user such that see-through cover 3 is able to pivot (as illustrated in FIG. 3) at its hinge along a first side edge 5 into a second configuration as illustrated in FIG. 2, wherein cover 3 remains attached to rucksack 1 but does not cover area of hook fastening 2.

Located on outer face of rucksack 1 and within area of hook fastening 2 is located an opening 23 to a pocket 10 of rucksack 1; the opening 23 to the pocket is openable and closable by means of zip fastening 9.

Pocket 10 may be employed by a user to store a range of decorations 8 such that the appearance of rucksack 1 may be customized at any time.

Turning to rucksack 1 in use, and in order to decorate area of hook fastening 2 a user must detach fastening tabs 7*a*, 7*b*, 7*c* from their corresponding areas of hook fastener so as to move see-through cover 3 into its second configuration.

It is in this configuration of see-through cover 3 that a user is able to attach decorations 8 comprising areas of loop fastening to area of hook fastening 2.

Figure 5:
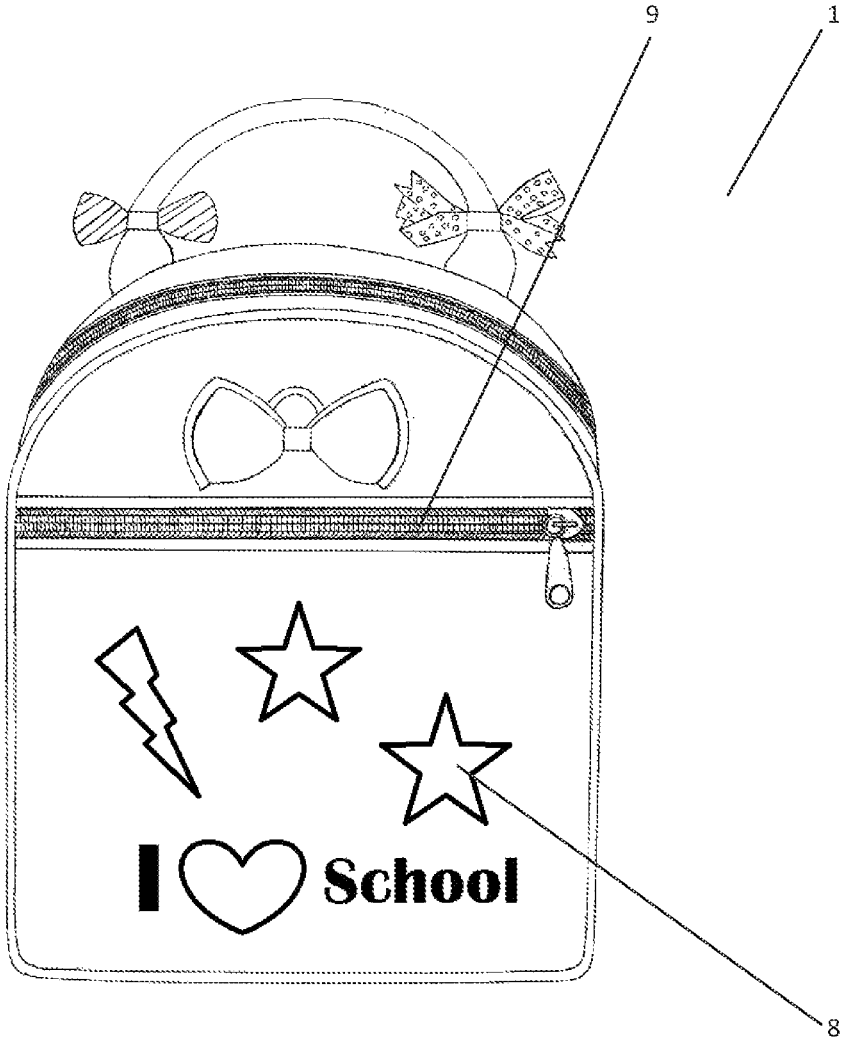
FIG. 5 is front view of the rucksack of FIG. 1, the rucksack having been decorated by a user.

Decorations 8 may include letters, whole words, images, shapes, symbols, photographs or other indicia and items as illustrated in FIG. 5.

When area of hook fastening has been decorated to the satisfaction of a user see-through cover 3 may then be returned to its first configuration such that pocket 10 for storing decorations 8 has its opening covered by cover 3.

Owing to cover 3 being see-through any decorations 8 located on area of hook fastening 2 remain visible when cover 3 overlays area of hook fastening 2.

When see-through cover 3 is in its first configuration such that see-through cover 3 overlays area of hook fastening 2, see-through cover 3 protects area of hook fastener 2 from fluff, hair or other dirt from attaching to area of hook fastening 2.

Furthermore, see-through cover 3 inhibits any decorations 8 from being lost through snagging on objects or other accidental detachment.

Even further, see-through cover 3 inhibits any loss of decorations from pocket 10 owing to the opening to pocket 10 is located under see-through cover 3, within a secondary pocket that is effectively formed by see-through cover 3 and area of hook fastening 2.

Although in the present embodiment an area of hook fastening 2 is positioned on the face of rucksack 1 it will be evident that in other embodiments an area of loop fastening may be provided and decorations incorporating hook fastening may be attached thereto.

Figure 6:
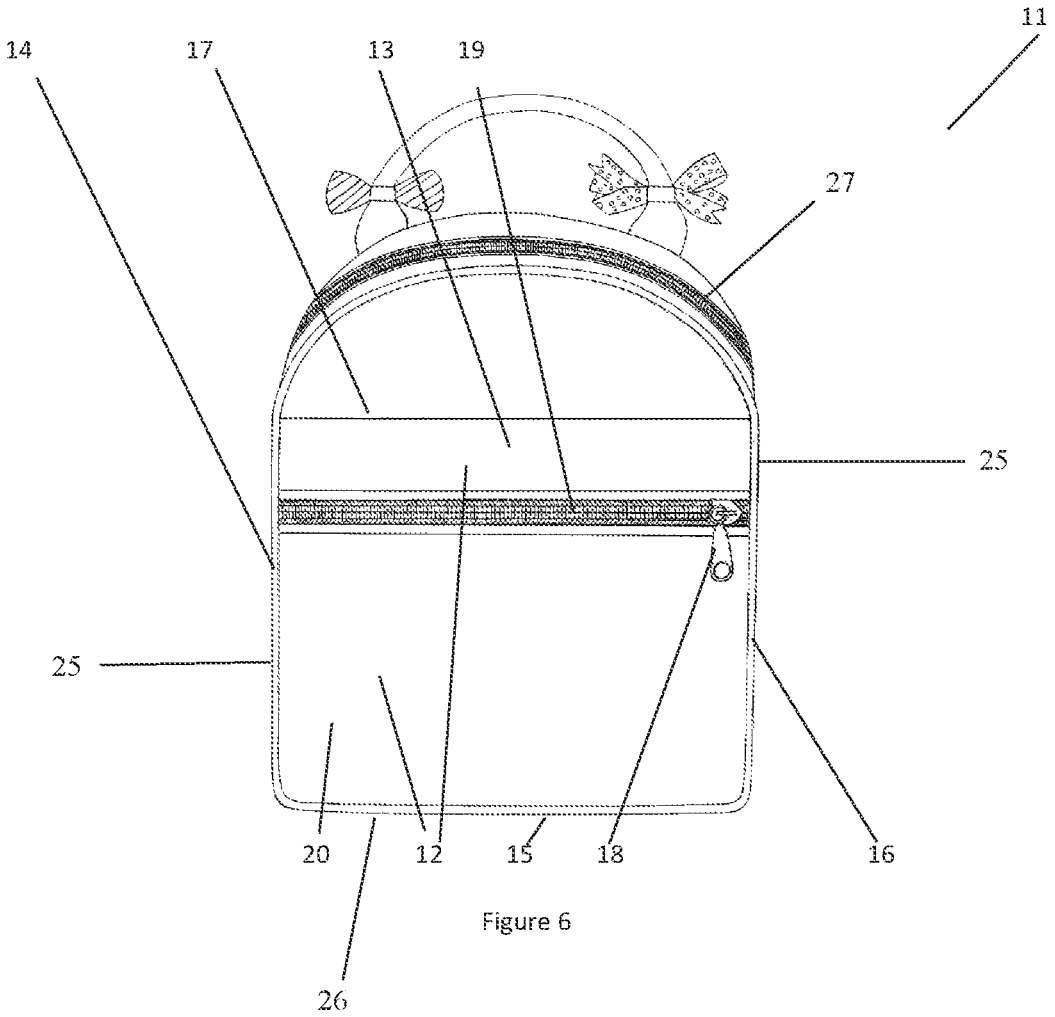
FIG. 6 is a view of a front of a rucksack made in accordance with a second embodiment of the present invention.

In other embodiments a see-though cover may not be movable between different configurations. Such an embodiment is illustrated in FIG. 6, wherein a rucksack 11 comprises a see-through cover 13 that is substantially rectilinear and forms a pocket on an outer face of rucksack 11 by being sealed to the item along three edges 14, 15, 16 but open along an upper edge 17.

In this embodiment see-through cover 13 forms a pocket on rucksack 11 such that the pocket is defined by a rear wall 21 comprising an area of hook fastening 12 and a front wall 22 comprising see-through cover 13.

Beneath see-through cover 13 is located zipper fastening 18 that is openable and closable by a user so as to access an internal pocket 19 of rucksack 11.

In order to affix decorations to area of hook fastening 12 and in order to access pocket 19 a user may reach under see-through cover 13 via the opening along upper edge 17.

In this specification the term 'see-through' is not intended to be limited to meaning entirely transparent, but may include material that is coloured or translucent; the important aspect of cover 3 of rucksack 1 is that any decorations 8 that are attached to area of hook fastening 2 are visible to some degree when cover 3 is in its first configuration.

However, it may be preferable for cover 3 to be substantially transparent.

In other embodiments only a portion of the cover may be see-through. In those embodiments a pocket may be located under a portion of the cover that is not see-through 20 such that the pocket is not visible during normal use. In some embodiments the cover might comprise a plurality of portions that are substantially see-through.

In this specification the terms 'decorative item' is intended to mean an item specifically adapted to be decorated by a user.

Many variations are possible without departing from the scope of the present invention as defined in the appended claims.

I claim:

1. A decorative item comprising:

a wall having an outer face, a second wall opposite to the wall, a pair of side walls, and a floor, the wall and the second wall being spaced apart from one another and each being secured to the pair of side walls, and the floor being secured to each of the side walls, the wall, and the second wall to define an interior compartment;

the wall having at least one area of hook or loop fastening configured to have a plurality of decorations attached thereto by a user, the plurality of decorations comprising corresponding hook or loop fastening;

a cover comprising at least a portion that is see-through, wherein the see-through portion is configured to overlay the at least one area of hook or loop fastening;

a pocket for storing the plurality of decorations having an opening located on the wall under the cover;

wherein the cover is changeable between first and second configurations; wherein: in a first configuration the cover is located in a substantially fixed position overlaying the opening of the pocket and the area of hook or loop fastening such that the plurality of decorations attached thereto are visible through the see-through portion; and in a second configuration the cover is not located over the area of hook or loop fastening such that a user may access the pocket through the opening and attach the plurality of decorations to and detach the plurality of decorations from the at least one area of hook or loop fastening.

2. The decorative item of claim 1 wherein the cover forms a secondary pocket on the item such that the secondary pocket is at least in part defined by a rear wall comprising an area of hook or loop fastening and a front wall comprising the see-through cover.

3. The decorative item of claim 1 wherein the cover is hingedly attached to the wall.

4. The decorative item of claim 1 wherein the cover is releasably fixable in the first configuration by means of at least one fastener.

5. The decorative item of claim 1 wherein the pocket for storing the plurality of decorations comprises at least one fastener to seal the opening.

6. The decorative item of claim 5 wherein the fastener is a zip.

7. The decorative item of claim 1 wherein the decorative item is one of an item of luggage, a bag, or a rucksack.

8. The decorative item of claim 1 wherein at least 50% of the cover is see-through, or at least 75% of the cover is see-through, or at least 90% of the cover is see-through.

9. The decorative item of claim 1 wherein the whole cover is see-through.

10. The decorative item of claim 1 wherein the see-through portion of the cover is transparent.

11. The decorative item of claim 1 wherein the pocket is located under the portion of the cover that is see-through.

12. A kit comprising:

a decorative item made in accordance with claim 1; and the plurality of decorations each comprising areas of hook or loop fastening configured to be attached to and detached from the at least one area of hook or loop fastening on the decorative item.

13. A method of decorating an item comprising the steps of:

a. providing a decorative item made in accordance with claim 1; and b. attaching at least one of the decorations from the plurality of decorations to the at least one area of hook or loop fastening on the item.

14. The decorative item of claim 1 wherein the at least one area of hook or loop fastening includes an upper area and a lower area, and the opening of the pocket on the wall is between the upper area and the lower area of hook or loop fastening.

* * * * *